US007530569B2

(12) United States Patent
White

(10) Patent No.: US 7,530,569 B2
(45) Date of Patent: May 12, 2009

(54) HIGH VOLUME ADJUSTABLE VACUUM ASSEMBLY FOR A ROLL IN AN INTERFOLDING MACHINE

(75) Inventor: Barton J. White, Freedom, WI (US)

(73) Assignee: Fabio Perini S.p.A., Lucca (IT)

( * ) Notice: Subject to any disclaimer, the term of this patent is extended or adjusted under 35 U.S.C. 154(b) by 469 days.

(21) Appl. No.: 10/966,611

(22) Filed: Oct. 15, 2004

(65) Prior Publication Data

US 2005/0082332 A1 Apr. 21, 2005

Related U.S. Application Data

(60) Provisional application No. 60/511,960, filed on Oct. 16, 2003.

(51) Int. Cl.
*B65H 5/04* (2006.01)

(52) U.S. Cl. ..... 271/276; 271/275

(58) Field of Classification Search ..... 271/226, 271/275, 276

See application file for complete search history.

(56) References Cited

U.S. PATENT DOCUMENTS

| | | | | |
|---|---|---|---|---|
| 1,053,914 | A * | 2/1913 | Hudson | 270/39.09 |
| 1,948,947 | A | 2/1934 | O'Keefe | |
| 2,062,855 | A | 12/1936 | Yeager | |
| 2,797,707 | A | 7/1957 | Hursh | |
| 3,146,794 | A | 9/1964 | Hollman | |
| 3,197,200 | A | 7/1965 | Byrt | |
| 3,572,686 | A | 3/1971 | Day | |
| 3,633,621 | A | 1/1972 | Myers | |
| 4,121,819 | A | 10/1978 | Difrancesco et al. | |
| 4,159,872 | A * | 7/1979 | Klann | 355/91 |
| 4,254,947 | A | 3/1981 | Trogan | |
| 4,270,744 | A * | 6/1981 | Trogan | 493/430 |
| 4,494,741 | A | 1/1985 | Fischer et al. | |
| 4,494,949 | A | 1/1985 | Baley | |
| 4,700,745 | A | 10/1987 | Ellis | |
| 5,147,273 | A | 9/1992 | Rottmann et al. | |
| 5,226,870 | A | 7/1993 | Smith et al. | |
| 5,358,163 | A * | 10/1994 | Naka | 226/95 |
| 5,411,245 | A | 5/1995 | Springer et al. | |
| 6,258,017 | B1 | 7/2001 | Singh | |
| 6,283,905 | B1 | 9/2001 | Singh | |
| 6,296,601 | B1 | 10/2001 | Couturier | |

(Continued)

*Primary Examiner*—Patrick H Mackey
*Assistant Examiner*—Howard Sanders
(74) *Attorney, Agent, or Firm*—Boyle Fredrickson, S.C.

(57) ABSTRACT

An interfolding machine includes a rotating roll with a series of ports configured to apply a vacuum pressure for holding and releasing sheet or web material. The interfolding machine further includes a valve assembly to regulate the vacuum pressure communicated to a surface of the rotating roll for holding the sheet or web material. The valve assembly generally includes an outer slug and an inner slug coupled by a pilot ring. A spool is mounted to the inner slug. The spool includes an opening to receive a draw of fluid through the outer and inner slugs. A cover defines a cavity with the spool in communication with the opening to the spool and a port in the cover. The outer slug and the inner slug define an intake region through which suction is supplied to the roll ports during a portion of the rotation of the roll. The outer slug and the inner slug are rotatably adjustable relative to the spool and to one another to regulate the length and position of the intake region.

20 Claims, 8 Drawing Sheets

U.S. PATENT DOCUMENTS 6,385,946 B1 5/2002 Singh
6,458,065 B1 10/2002 Niedermeyer
6,539,829 B1 4/2003 Kauppila et al.

* cited by examiner

HIGH VOLUME ADJUSTABLE VACUUM ASSEMBLY FOR A ROLL IN AN INTERFOLDING MACHINE

RELATED APPLICATIONS

This application claims the benefit under 35 U.S.C. § 119 (e) of U.S. Provisional Application Ser. No. 60/511,960, filed Oct. 16, 2003, the entirety of which is hereby incorporated herein by reference.

FIELD OF THE INVENTION

This invention generally relates to an interfolding machine for interfolding sheet or web material, and more specifically, to an interfolding machine that includes an assembly that provides on the fly adjustment for an on/off position of a vacuum for selectively holding and releasing of the sheet or web material on certain rolls incorporated in the interfolding machine.

BACKGROUND OF THE INVENTION

Interfolding of sheet material (e.g., napkins, paper towels, tissue, etc.) is frequently performed using a series of rolls that cooperate to sever web material into sheets, overlap the sheets, and interfold the overlapped sheets to form an interfolded stack of sheets. Certain of the rolls include a vacuum system having vacuum ports on the outer surface of the roll, which are selectively supplied with vacuum to hold and release the sheets during rotation of the roll.

In a typical prior art system, a roll is internally drilled to route air flow from the roll surface to the roll sides. Stationary side valves are spring loaded against the roll sides to encapsulate the vacuum ports on the rolls sides. Each side valve is in the form of a plate which has a rectangular cross section, circular cavity machined into the side of the valve face, which bears against the roll side. The valve cavity matches the ports in the roll side. The valve cavity intersects a perpendicular supply port that interfaces the valve with a vacuum supply system. Partial segment slugs are positioned in the valve cavity, so as to correspond to vacuum on/off points in rotation of the roll. The slugs are held in position with bolts through slots in the outer sides of the valve.

While a system of this type functions adequately, it requires the interfolding machine to be stopped and the slugs manually moved within the slots in order to alter the on/off points of the vacuum supplied to the roll surface. Furthermore, the thickness of the side valve plate defines a bottleneck that limits the strength of the vacuum that can be supplied to the surface of the roll.

SUMMARY OF THE INVENTION

In accordance with the present invention, there is provided a valve assembly to regulate the supply of suction or vacuum communicated from a vacuum source, such as a vacuum pump, to a surface of a web or sheet handling roll. The valve assembly is stationarily mounted to the roll journal, and includes an outer slug and an inner slug coupled by a pilot ring. A spool is mounted to the inner slug. The spool includes an opening to receive a draw of air through the outer and inner slugs. A cover or manifold is coupled to the spool, and includes a port that communicates with the vacuum source. The cover and the spool define a cavity, which communicates with the opening in the spool and with the port in the cover to define an air flow path from the roll surface to the vacuum source. The outer slug and the inner slug are configured to regulate the flow of air from the roll surface into the cavity. The outer slug and the inner slug are rotatably adjustable relative to the spool and relative to one another, to control the on/off positions at which suction or vacuum is supplied to the roll surface. The slugs are configured to be adjustable while the roll is rotating, to provide on-the-fly adjustment of the on/off positions. The cavity and manifold design significantly increases airflow volume over prior art systems.

In accordance with another aspect of the invention, there is provided an interfolding machine for handling and interfolding sheet or web material. The interfolding machine includes a rotating roll for holding and the releasing sheet or web material. The rotating roll generally includes a plurality of holes along an outer surface for communicating suction or vacuum to the sheet or web material. The interfolding machine further includes a valve assembly for the rotating roll, which includes an outer slug, an inner slug, and a pilot ring rotatably coupling the outer slug and the inner slug. The valve assembly further includes a spool mounted to the inner slug, and a cover or manifold coupled to the spool. The spool generally includes an opening, and the cover or manifold defines a cavity within which the spool is located. The cavity defined by the cover or manifold is in communication with the opening of the spool. The outer slug and the inner slug are rotatably adjustable relative to the spool and relative to one another.

In accordance with a further aspect of the present invention, there is provided a method of regulating the supply of suction or vacuum to a surface of a rotating roll having a series of suction or vacuum ports that open onto the surface of the roll, and suction or vacuum supply passages that open onto a side of the roll. The method includes the acts of providing a vacuum source to draw air into the suction or vacuum ports of the roll; drawing the flow of fluid into through the passages and the openings in an outer slug and an inner slug into a cavity defined by a spool and a cover or manifold; and communicating the flow of fluid through the cover or manifold to the vacuum source. The method further includes rotatably adjusting the opening of the outer slug relative to the opening of the inner slug during rotation of the roll, i.e., while interfolding machinery is running, so as to so as to control the on/off positions at which suction or vacuum is supplied to the surface of the roll.

Other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout. In the drawings.

DETAILED DESCRIPTION OF THE PREFERRED EMBODIMENTS

1. Interfolding Machine

Figure 1:
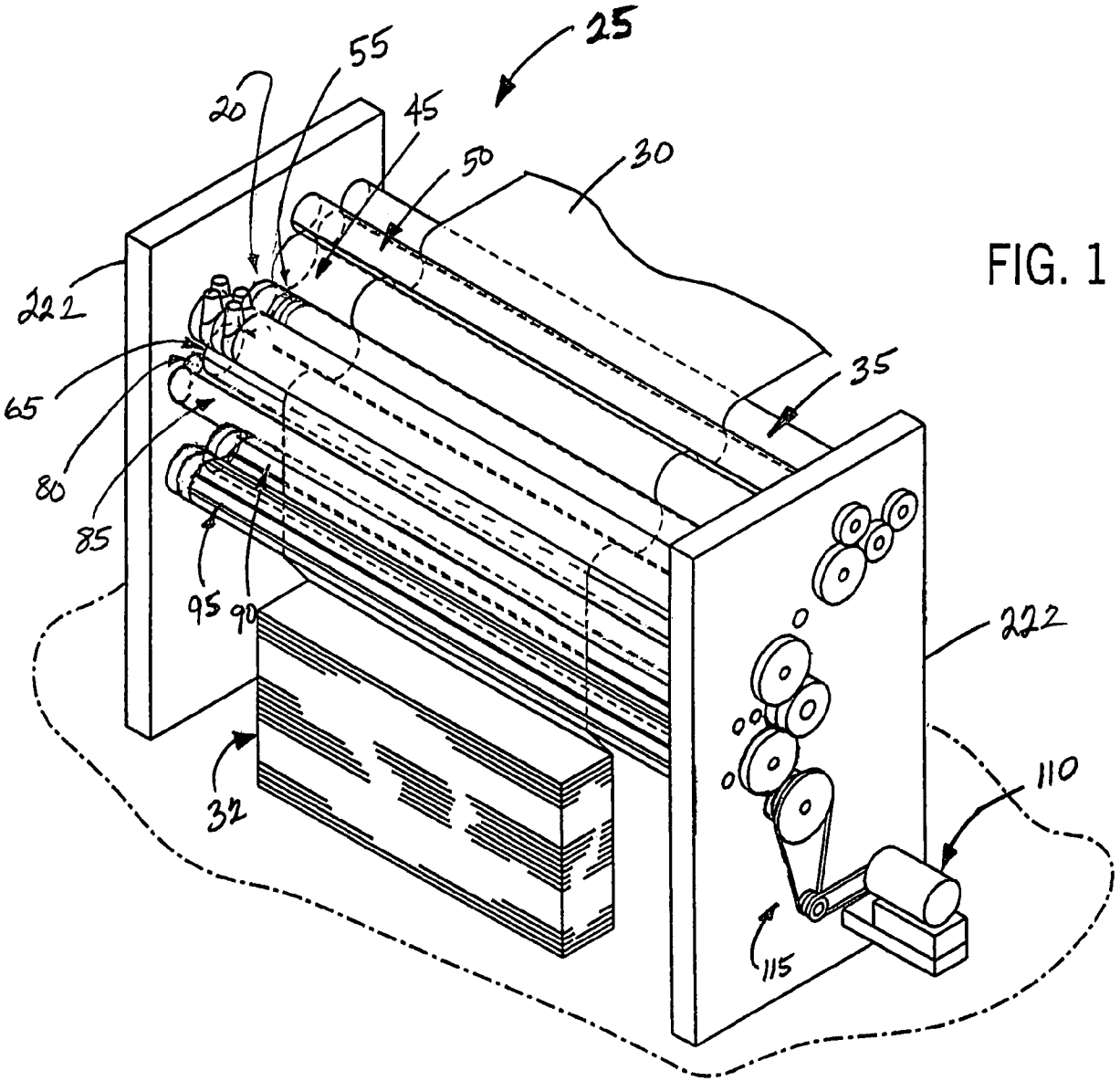
FIG. 1 is an isometric view of an interfolding machine employing a vacuum assembly in accordance with the present invention.
Figure 2:
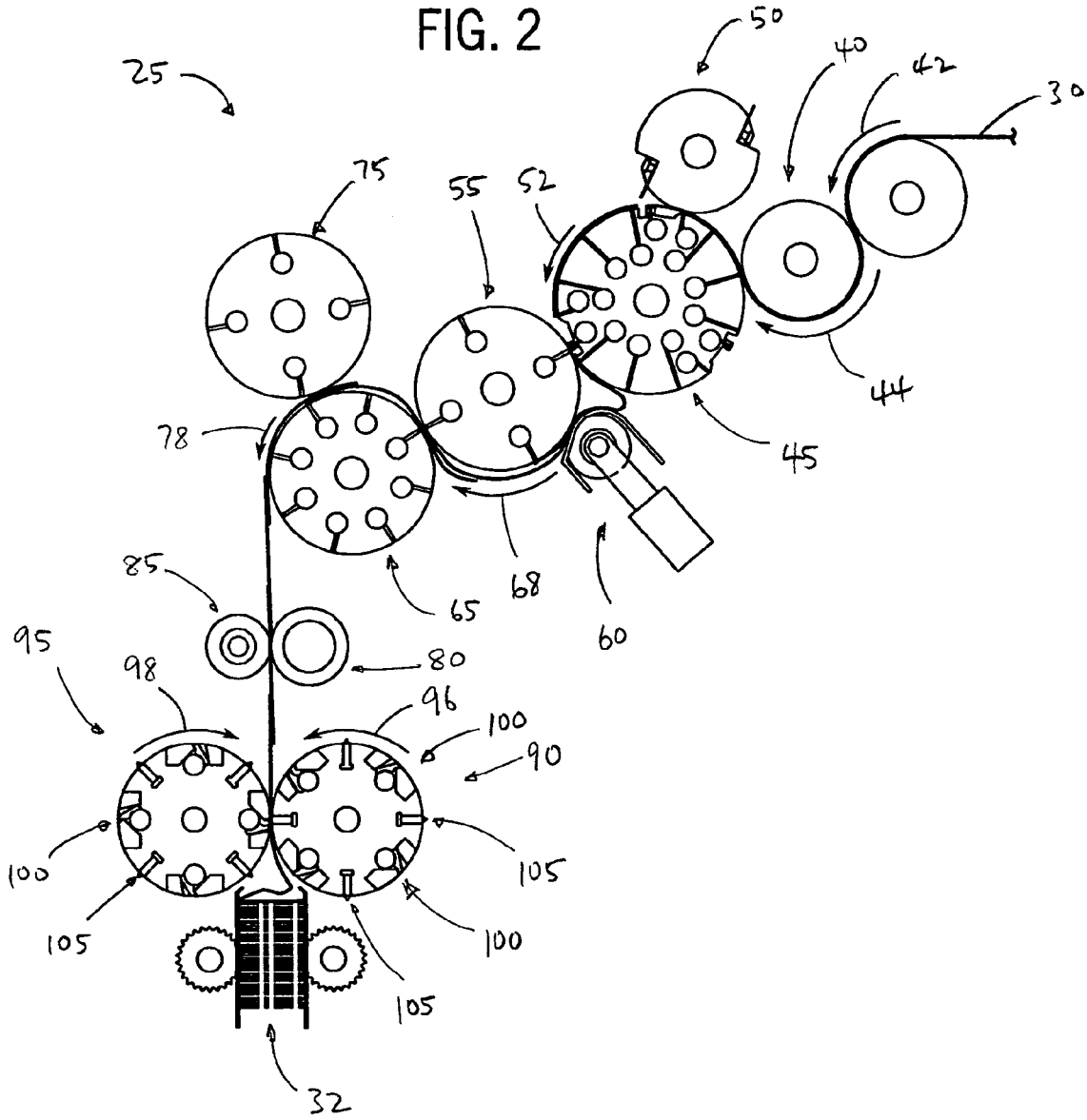
FIG. 2 is a schematic side elevation view of the interfolding machine as shown in FIG. 1.

Referring to FIGS. 1 and 2, an interfolding machine 25 is operable to convert a web of material 30 into a stack of interfolded sheets of material shown at 32. Interfolding machine 25 generally includes a first pull roll 35 and a second pull roll 40 that receive the web of material 30 along a path (illustrated by an arrow 42 in FIG. 2) from a supply roll (not shown) into the interfolding machine 20. The first and second pull rolls 35 and 40 define a nip through which the web of material 30 passes, and function to unwind the web of material 30 and feed the web of material 30 in a path (illustrated by an arrow 44 in FIG. 2) toward a nip defined between second pull roll 40 and a bed roll 45. The web of material 30 is then advanced by bed roll 45 toward a knife roll 50. In a manner as is known, the knife roll 50 cuts the web of material 30 into sheets, each of which has a predetermined length, and the bed roll 45 carries the sheets of material along a path (illustrated by arrow 52 in FIG. 2) toward and through a nip defined between bed roll 45 and a retard roll 55, which rotates at a slower speed of rotation than the bed roll 45. In a manner as explained in copending application Ser. No 10/953,175 filed Sep. 29, 2004, the retard roll 55 cooperates with a nip roller assembly 60 (FIG. 2) to form an overlap between the consecutive sheets of material. The retard roll 55 carries the overlapped sheets of material along a path (illustrated by arrow 68 in FIG. 2) to a lap roll 65.

The lap roll 65 works in combination with a count roll 75 to eliminate the overlap between adjacent sheets of material at a predetermined sheet count, so as to create a separation in the stack 32 of interfolded sheets discharged from the interfolding machine 25. The lap roll 65 carries the overlapped sheets 30 along a path (illustrated by arrow 78 in FIG. 2) toward a nip defined between a first assist roll 80 and an adjacent second assist roll 85. The first and second assist rolls 80 and 85 feed the sheets of the material to a nip defined between a first folding roll 90 and a second folding roll 95.

Referring to FIG. 2, the first and second folding rolls 90 and 95 generally rotate in opposite directions (illustrated by arrows 96 and 98, respectively, in FIG. 2) to receive the overlapped sheets of material 30 therebetween. The periphery of the first folding roll 90 generally includes a series of the gripper assemblies 100 and a series of tucker assemblies 105 uniformly and alternately spaced to interact with a series of gripper assemblies 100 and tucker assemblies 105 of the adjacent second folding roll 95. The series of alternately spaced gripper assemblies 100 and tucker assemblies 105 of the first and second folding rolls 90 and 95 interact to grip, carry, and release the sheets of material in a desired manner so as to form the desired interfolded relationship in the sheets of material and to form stack 32 of interfolded sheets. The folding rolls 90 and 95 may be driven by a drive system 110 having a drive belt assembly 115 (FIG. 1).

The stack 32 of interfolded sheets is discharged from between the first and second folding rolls 90 and 95 in a generally vertically-aligned fashion. The stack 32 of interfolded sheets may be supplied to a discharge and transfer system (not shown), which guides and conveys the stack 32 from the generally vertically-aligned orientation at the discharge of the interfolding machine 25 to a generally horizontally-aligned movement. One embodiment of a suitable discharge and transfer system is described in U.S. Pat. No. 6,712,746 entitled "Discharge and Transfer System for Interfolded Sheets," filed May 5, 2000, the disclosure of which is hereby incorporated herein by reference in its entirety. Another representative discharge and transfer system is illustrated in copending application Ser. No. 10/610,458 filed Jun. 30, 2003, the disclosure of which is also hereby incorporated herein by reference in its entirety.

2. Vacuum Assembly

Figure 3:
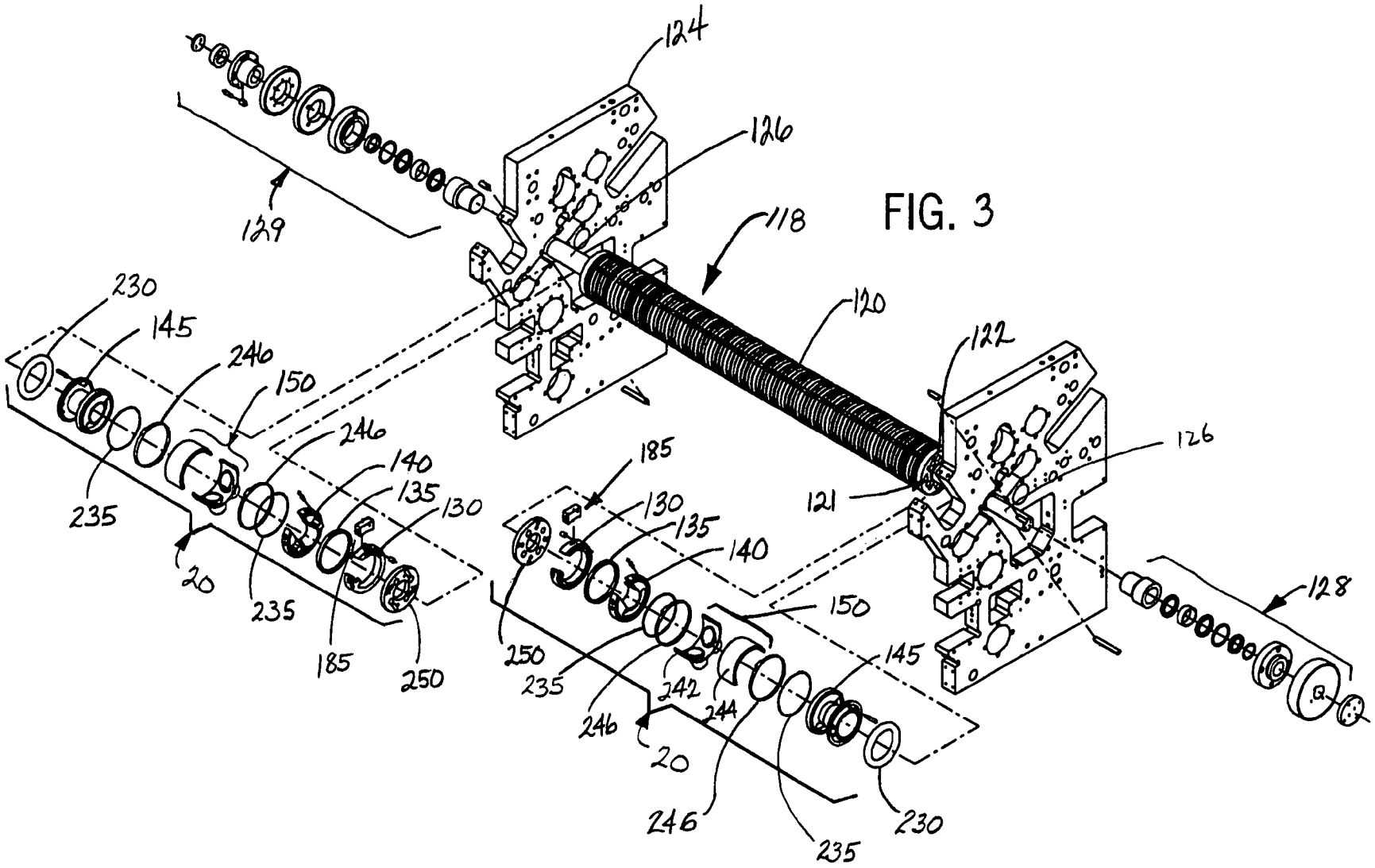
FIG. 3 is an exploded isometric view of the components of the vacuum assembly of the present invention, shown in combination with one of the rolls of the interfolding machine of FIG. 1.
Figure 4:
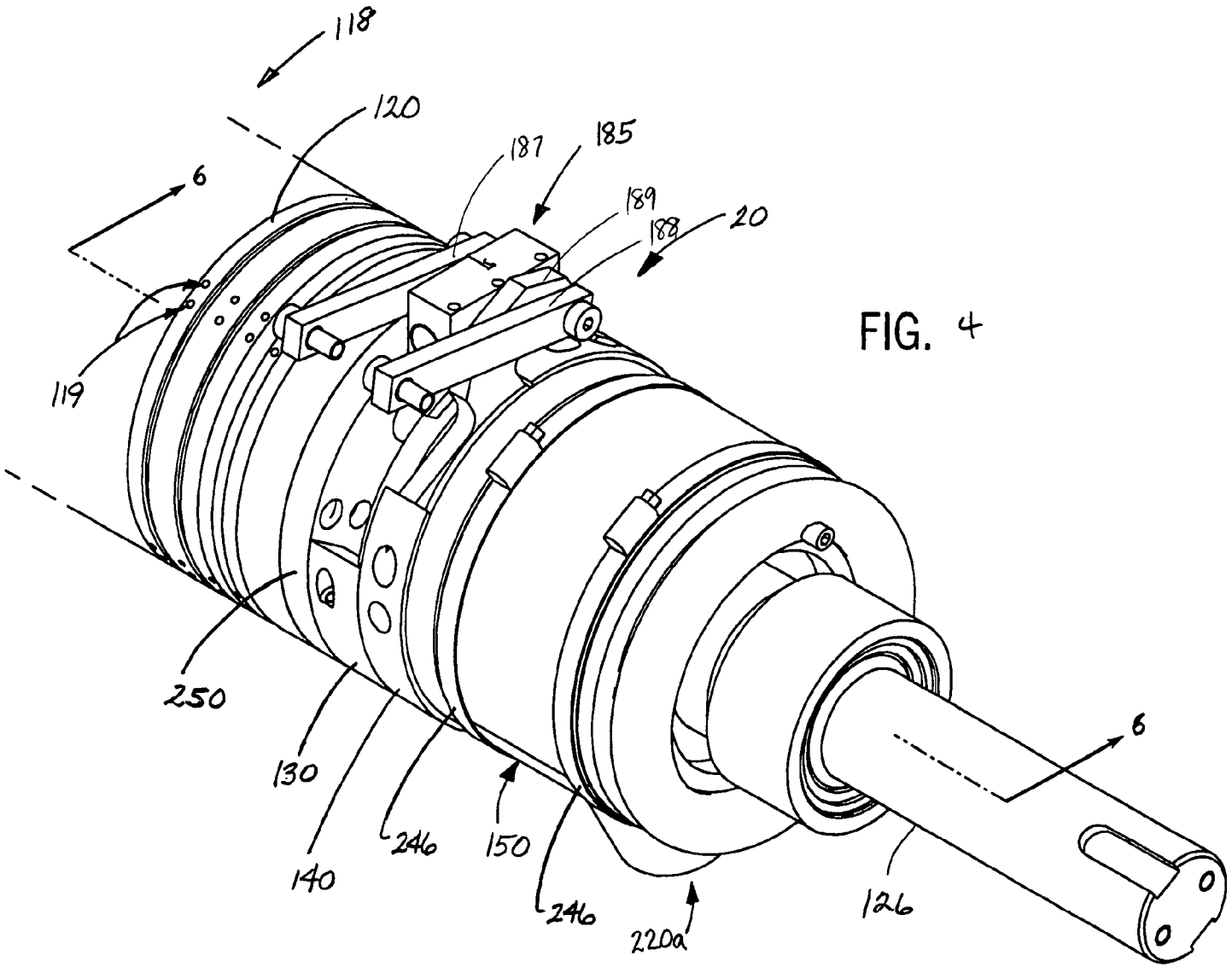
FIG. 4 is an isometric assembly view of the vacuum assembly of the present invention, the components of which are shown in FIG. 3.
Figure 5:
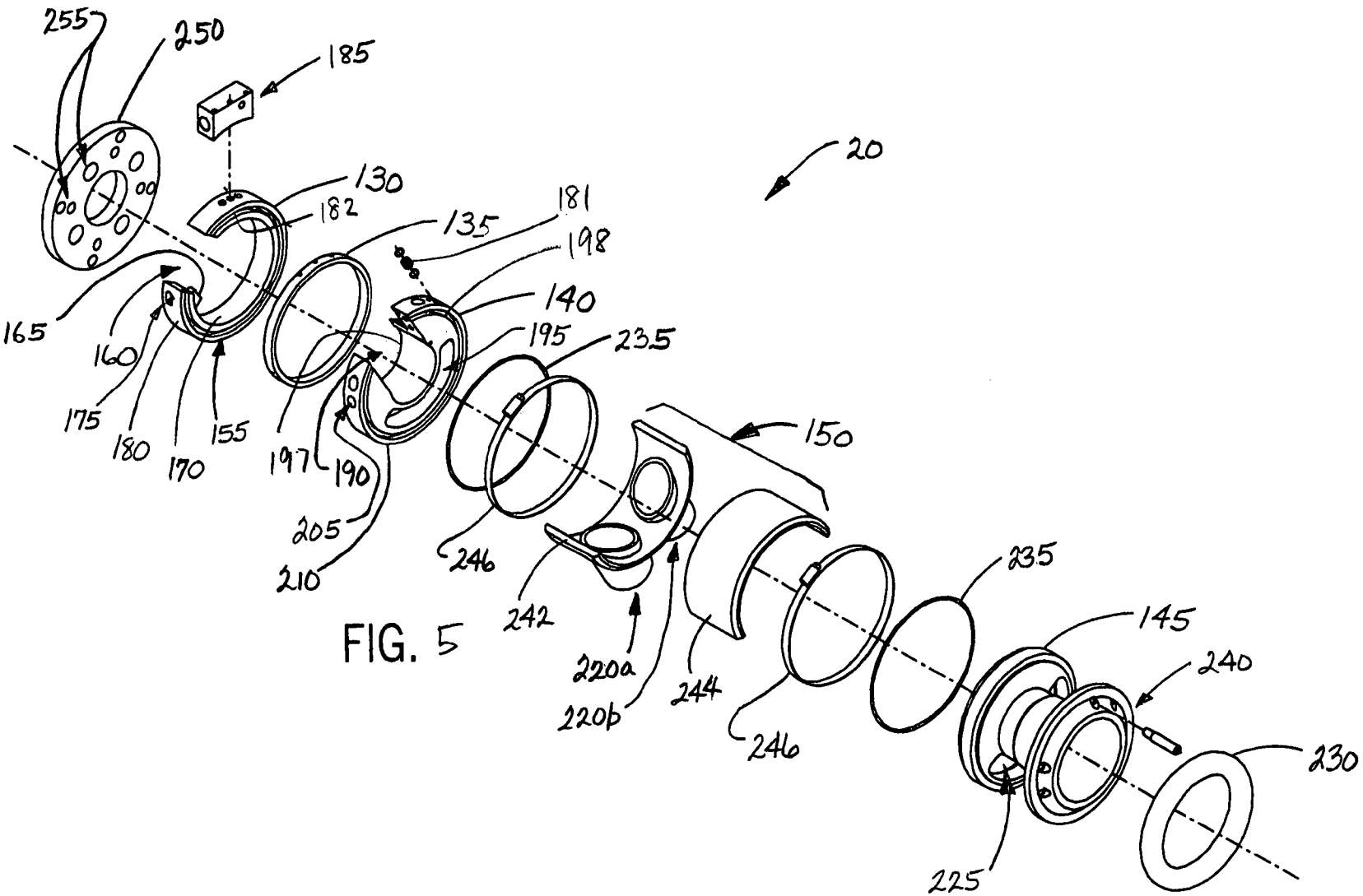
FIG. 5 is an enlarged exploded isometric view of the components of the vacuum assembly shown in FIG. 4.
Figure 6:
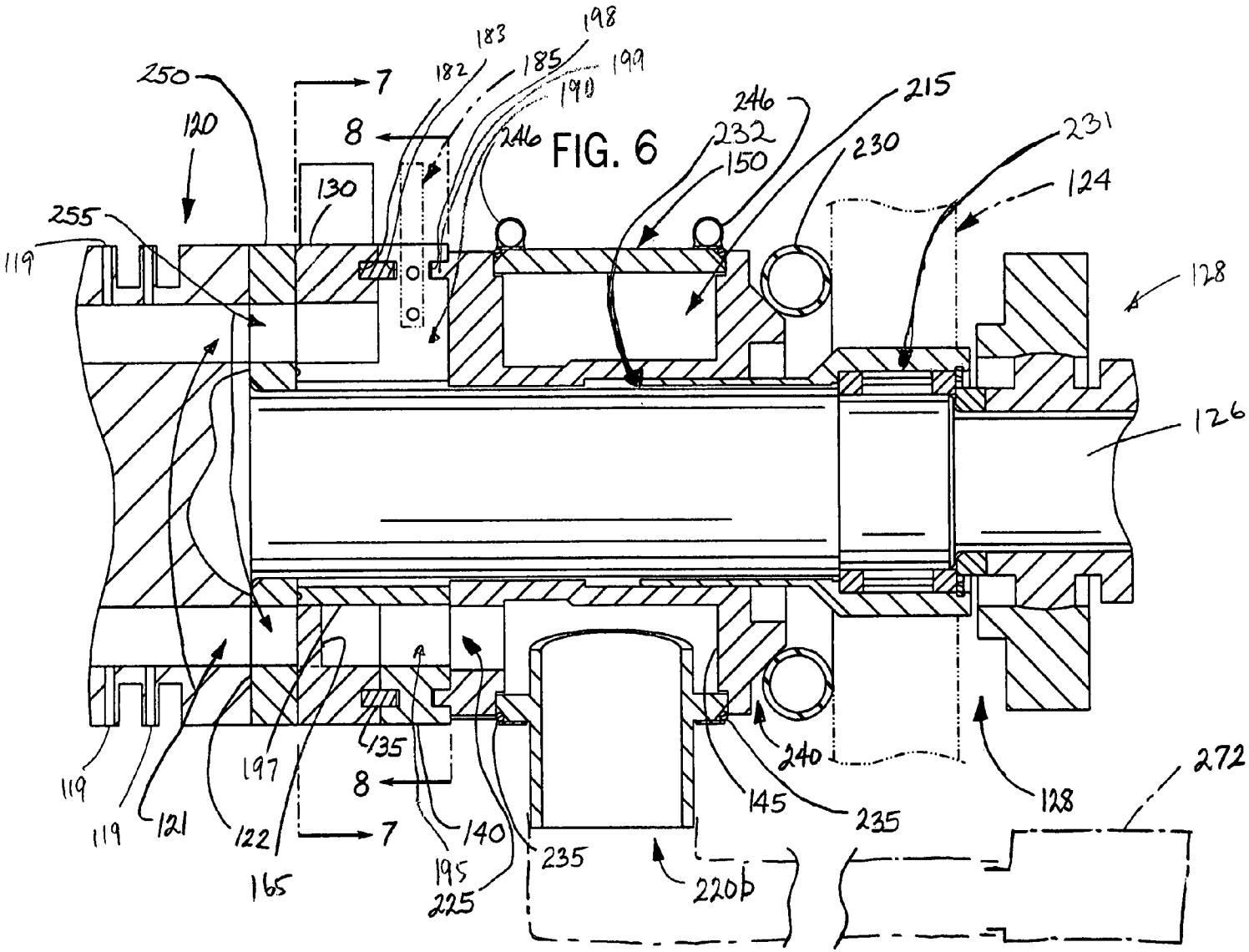
FIG. 6 is a cross-sectional view of the vacuum assembly along line 6-6 of FIG. 4.

FIGS. 3-6 illustrate one embodiment of a vacuum valve assembly 20 in accordance with the present invention, for supplying a suction or vacuum to a surface of a rotating roll 118. The rotating roll 118 can be, but is not limited to, any of previously described rolls that include a suction feature for holding a sheet or web to the roll, e.g., bed roll 45, retard roll 55, lap roll 65, etc. As shown in FIGS. 4 and 6, the roll 118 is drilled to internally route the fluid flow (e.g., suction or vacuum pressure) from holes 119 at a roll surface 120 to side ports 121 at a roll side or face 122. The vacuum valve assembly 20 is located between a machine frame 124 and the roll face 122, and is generally held stationary and piloted on a roll journal 126 at each end of the rotating roll 118. A gear drive assembly 128 and/or an end coupling assembly 129 is engaged with the end of roll journal 126 externally of frame 124, for imparting rotation to roll 118 in a manner as is known.

Referring to FIGS. 3 and 4, the valve assembly 20 generally includes an outer adjustable slug plate 130, a pilot ring 135, an inner adjustable slug plate 140, a spool 145, and a cover/manifold 150. The outer and inner slug plates 130 and 140 are rotatably adjustable relative to the spool 145 as well as relative to each other.

As illustrated in FIGS. 3 and 5, the outer 130 and inner 140 slug plates are piloted on the pilot ring 135 and on the spool 145. In the illustrated embodiment, outer slug plate 130 generally includes a ring shaped body 155 having a gap 160 and an inner extension 165. The size of the gap 160 can vary. The inner extension 165 generally extends radially inward from an inner arcuate surface 170 of the ring-shaped body 155. The size and location of the extension 165 can vary. The outer slug plate 130 further includes one or more lubrication passages or openings 175 extending from an exterior surface, shown at 180, to the inner surface 170 of the outer slug plate 130.

The pilot ring 135 couples or attaches the outer slug plate 130 to the inner slug plate 140 such that the outer slug plate 130 is rotatable relative to the inner slug plate 140. Fasteners, such as screws 181, extend into threaded passages in inner slug plate 140 and into engagement with pilot ring 135, to prevent rotation of pilot ring 135 relative to inner slug plate 140. The pilot ring 135 generally maintains the concentricity between the outer 130 and the inner 140 slug plates. In the illustrated embodiment, outer slug plate 130 and inner slug plate 140 are formed with facing grooves 182, 183, respectively, within which pilot ring 135 is engaged, to enable relative rotation between outer slug plate 130 and inner slug plate 140.

Referring to FIGS. 4 and 5, a block 185 is mounted to the external surface of outer slug plate 130. A link 187 is mounted to block 185, and is used to control the rotational position of outer slug plate 130. A link 188 is coupled to an arm 189, which is secured within the open end of inner slug plate 140 defined by opening 190, and is used to control the rotational position of inner slug plate 140. In a manner to be explained, the links 187 and 188 are used to radially position the outer slug plate 130 relative to the inner slug plate 140, to allow an operator to make adjustments to the ON/OFF operation of the vacuum valve assembly 20 while the rotating roll 118 is moving and the machine 25 is running. The wear parts, including the outer slug plate 130 and the inner slug plate 140, are configured and mounted such that they can be readily removed from and re-installed on the interfolding machinery 20 for service or replacement.

Referring to FIGS. 4-6, the inner slug plate 140 establishes communication between the interior of the vacuum valve assembly 20 and the roll face 122 of the rotating roll 118. In the illustrated embodiment, inner slug plate 140 includes a U-shaped opening 190 and a separate arcuate, oval opening 195. The inner slug plate 140 includes an inner extension section 197, through which opening 195 extends, and inner extension section 197 overlaps outer slug plat 130. The inner slug plate 140 includes a groove 198 that faces the adjacent end surface of spool 145. A guide ring 199 is formed on the facing end surface of spool 145, and is received within groove 198, to locate inner slug plate 140 on spool 145 and to guide rotational movement of inner slug plate 140 relative to spool 145. With this construction, inner slug plate 140 is rotatable relative to the outer slug plate 130 and the spool 145, to adjust the positions of openings 190 and 195. The size and location of the opening 195 generally aligns with the dimensions of the extension 165 of the outer slug plate 130. That is, outer slug plate extension 165 is configured such that its inner end is located closely adjacent the outer surface defined by inner extension section 197 of inner slug plate 140. The U-shaped opening 190 is generally configured to communicate certain of the holes 119 at the circumference or surface 120 of the rotating roll 118 (FIG. 3) with atmosphere (FIG. 6). Furthermore, FIG. 5 illustrates the inner slug plate 140 includes a plurality of lubrication ports or passages or openings 205 extending from an exterior surface 210 to the U-shaped opening 190 of the inner slug 140. The shape, number, and size of the above-described openings 190, 195, and 205 can vary.

Still referring to FIGS. 4-6, the spool 145 and the cover/manifold 150 generally define an internal cavity 215 supplied with negative air pressure from a vacuum source, such as a vacuum pump 272, through fittings or ports 220*a* and 220*b* on the cover or manifold 150. An inner end of the spool 145 includes an air flow opening 225. The air flow opening 225 of the spool 145 is configured with the openings 190 and 195 of the inner slug 140 and the outer slug 130 to regulate supply of vacuum or suction to the ports 121 at the face 122 of the roll 118, and thereby to the holes 119 in the outer surface of the roll. An outer circular spring 230 is disposed at an end 240 of the spool 145 adjacent the frame 124 of the machine 25, and applies axial pressure that maintains vacuum assembly 20 in engagement against the roll face 122. Roll journal 126 extends through a cup 231 having an axially extending sleeve 232, which cooperate to pilot vacuum assembly on roll journal 126. A conventional bearing assembly is positioned between cup 231 and roll journal 126 to accommodate rotation of roll journal 126 relative to vacuum assembly 20. An inner pair of gaskets 235 or O-rings are disposed between the ends of spool 145 and the cover 150.

The cover or manifold 150 generally includes an inlet portion or component 242 that generally defines a first portion of the circumference of the cover 150, and a cover portion 244 that generally defines a remaining portion of the cover 150. The inlet portion 242 includes the ports 220*a* and 220*b* of the cover 150. The inlet and cover portions 242 and 244 are generally coupled together by clamp-type couplings 246. The gaskets 235 are generally disposed between the cover 150 and the spool 145, to provide an air-tight seal to internal cavity 215.

A wear plate 250 is disposed between the vacuum valve assembly 20 and the face 122 of the roll 118. The wear plate 250 is mounted to the face 122 of the roll 118, and rotates with the rotating roll 118. The wear plate 250 generally includes a plurality of openings 255 that communicate the suction from the valve assembly 20 to the vacuum ports 121 at the face 122 of the rotating roll 118.

Figure 7:
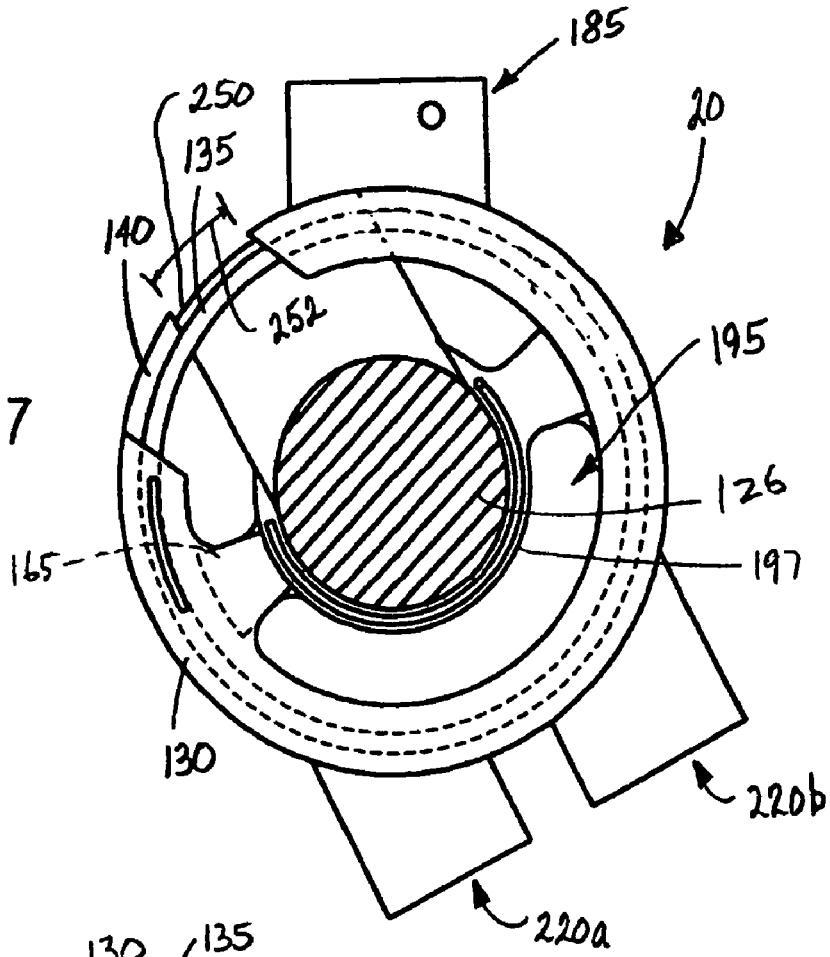
FIG. 7 is cross-sectional view of the vacuum assembly along line 7-7 of FIG. 6.
Figure 8:
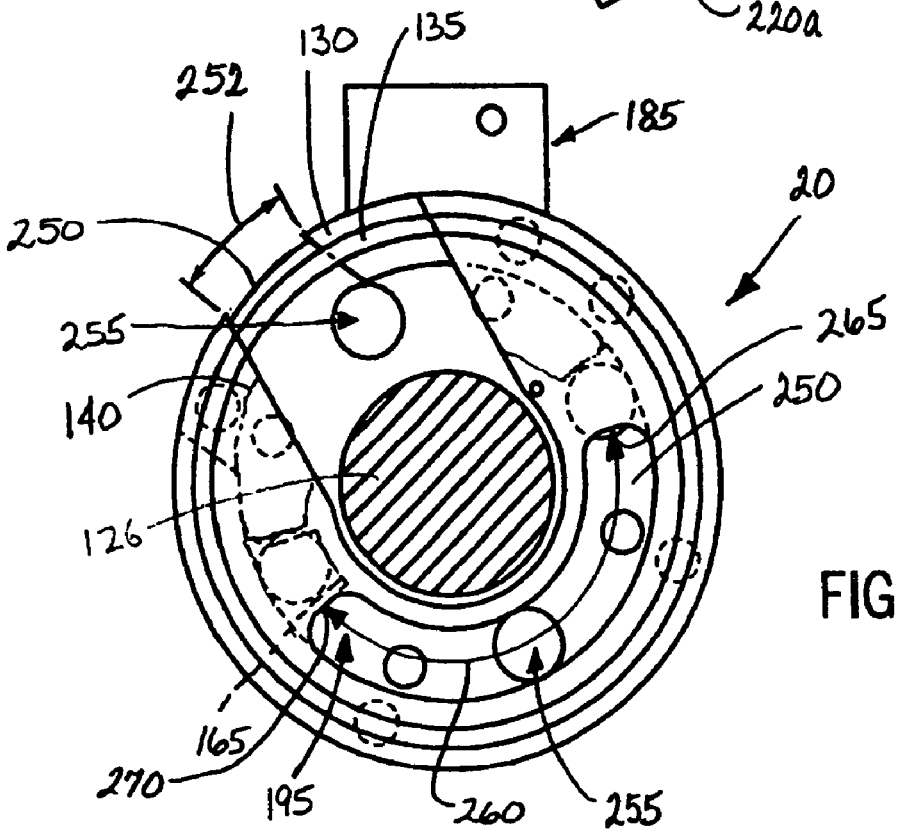
FIG. 8 is a cross-sectional view of the vacuum assembly along line 8-8 of FIG. 6, showing the vacuum assembly in a first position.

FIGS. 7 and 8 illustrate the outer slug plate 130 at an initial or first position (referenced by dimension 252) relative to the inner slug plate 140 of the vacuum valve assembly 20. An intake region 260 defines the sweep through which the openings 255 of the wear plate 250 are exposed to the suction or vacuum from internal cavity 215 during rotation of roll 118. Intake region 260 is generally defined by the area of opening 195 to which openings 255 are exposed upon rotation of roll 118, and is located between a point 265 at one end of the opening 195 of the inner slug plate 140, and a point 270 along one face of the extension 165 of the outer slug plate 130. In the position of FIG. 8, the edge of the extension 165 of outer slug plate 130 is coincident with the adjacent edge of opening 195 of inner slug plate 140, so that extension 165 does not overlap opening 195. In this position, the maximum area of opening 195 is exposed, to define the maximum dimension of intake region 260 and therefore the maximum sweep through which openings 255 are exposed to suction, i.e. the maximum portion of the rotation of roll 118 during which suction is supplied to holes 119 in roll 118. That is, wear plate openings 255 are exposed to suction throughout the entirety of inner slug plate opening 195. The dimension of intake region 260 is controlled by the position of the extension 165 of the outer slug plate 130 relative to opening 195, which in turn is controlled by the relative positions of inner slug plate 140 and outer slug plate 130. The outer slug plate 130 can be rotated to vary the position of extension 165 relative to the outer slug plate opening 195 or the inner slug plate opening 190, to control the dimension of intake region 260 and therefore the sweep of the openings 255 of the wear plate 250 exposed to the vacuum or suction.

Figure 9:
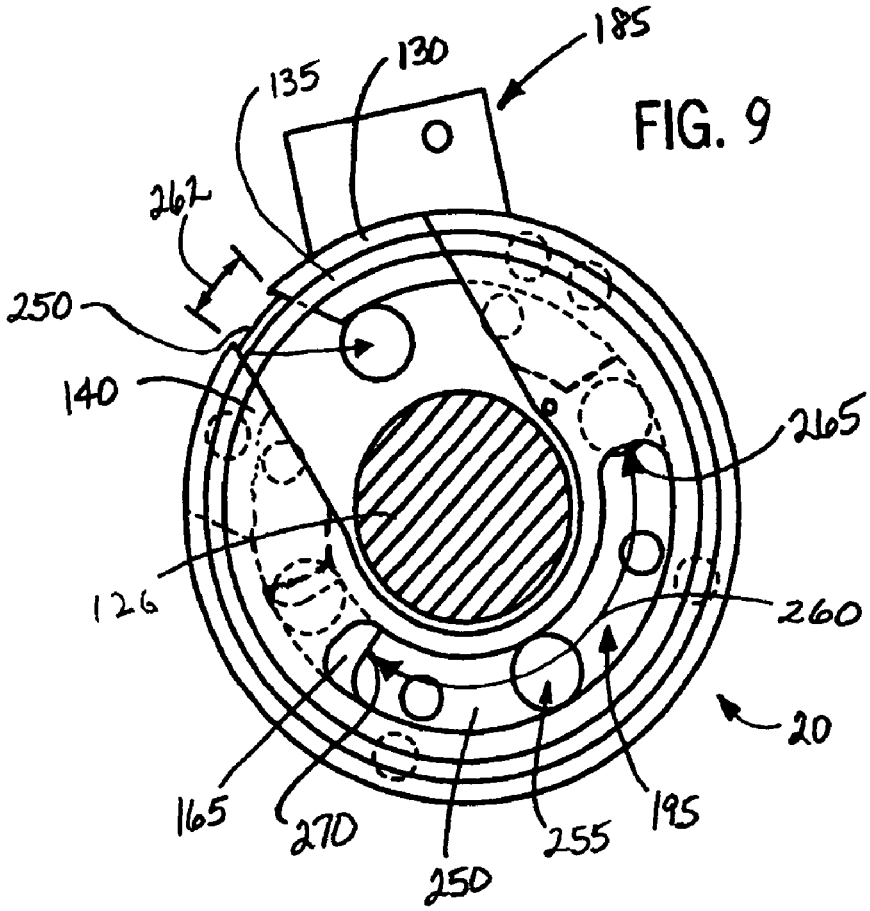
FIG. 9 is a view similar to FIG. 8, showing the vacuum assembly in a second position.
Figure 10:
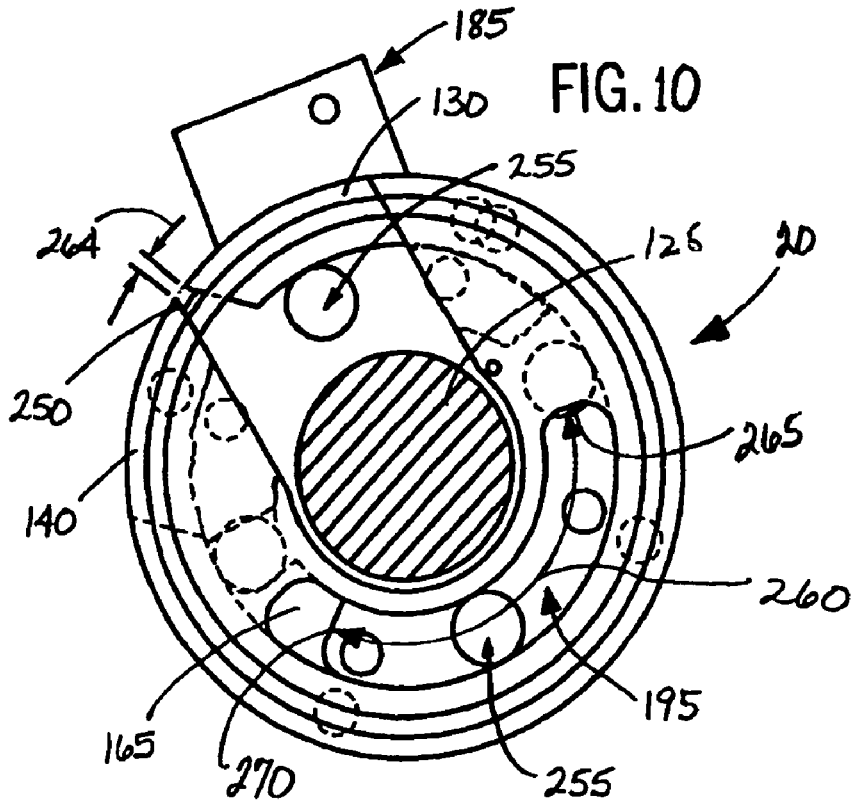
FIG. 10 is a view similar to FIGS. 8 and 9, showing the vacuum assembly in a third position.

FIG. 9 illustrates the outer slug plate 130 rotated counterclockwise to a second position (referenced by dimension 262) relative to the inner slug plate 140 of the valve assembly 20. In this position, intake region 260 is reduced in length relative to the maximum length of intake region 260 as shown in FIG. 8, in that extension 165 of outer slug plate 130 extends into opening 195 beyond the adjacent edge of opening 195. In this manner, the overall length of travel during which suction is supplied to holes 119 can be adjusted. FIG. 10 illustrates a further adjustment by rotation of outer slug plate 130 counterclockwise to a third position (referenced by dimension 264) relative inner slug plate 140 of the valve assembly 20. In this position, intake region 260 is reduced in length relative to the length of intake region 260 as shown in FIG. 9, in that extension 165 of outer slug plate 135 overlaps opening 195 a greater amount than in the position of FIG. 9. This functions to reduce even more the overall length of travel during which suction is supplied to holes 119 of roll 118 during rotation of roll 118. To adjust the position at which suction is supplied to holes 119 and cut off from holes 119 during rotation of roll 118, outer slug plate 130 and inner slug plate 40 are together moved to a desired rotational position, to place intake region 260 in a desired location within the path of rotation of roll 118.

In operation, suction or a vacuum pressure is supplied to the interior of cover/manifold 150 from a vacuum or suction source, such as vacuum pump 272, through fittings 220*a* and 220*b*. When roll 118 is positioned such that wear plate openings 255 are aligned with intake region 260, airflow is routed from the vacuum holes 119 at the surface 120 of the roll 118, through the side ports 121 at the roll face 122, and into the valve assembly 20 through wear plate openings 255. The flow of air continues through outer slug plate 130 and inner slug plate 140 through inner slug plate opening 195, and into the cavity 215 defined by the spool 145 and cover/manifold 150. From the cavity 215, the flow of air continues in and out through the cover/manifold 150 to the vacuum pump 272.

The valve assembly 20 is configured so that the adjustments to the dimension and position of intake region 260 can be accomplished during operation of the interfolding machine 25, i.e. while the roll 118 is rotating. This on-the-fly adjustment enables an operator to make adjustments without stopping operation of interfolding machine 25, to eliminate loss of production caused by machine downtime. Also, the valve assembly 20 allows ready removal of the wear parts, such as outer slug plate 130 and inner slug plate 140, for servicing or replacement. The configuration of valve assembly 20 is such that fluid flows directly through the intake region 260 defined by outer slug plate 130 and inner slug plate 140, and into the cavity 215 to the vacuum pump 272. This straight-through porting into cavity 215 eliminates bottlenecks and frictional losses that occur in a conventional valve which has turns and bends in the airflow path, thus increasing responsiveness in the supply of suction to the roll surface. Suction is supplied to the roll passages directly from the aligned cavity, which results in an increase in the capacity and the volume of air removed through the side ports 121 at the face 122 of the rotating roll 118. Manifold/cover 150 allows the use of multiple manifold ports, such as 220*a* and 220*b*, to accommodate the increased volume of fluid flow.

A wide variety of machines or systems could be constructed in accordance with the invention defined by the claims. Hence, although the exemplary embodiment of a vacuum assembly 20 in accordance with the invention has been generally described with reference to an interfolding machine for holding overlapped sheets or web material 30 to be interfolded into a stack 32, the application of the vacuum assembly 20 is not so limited. The vacuum assembly 20 of the invention could be employed to supply vacuum or suction to the surface of a roll for a wide variety of uses or applications, and the illustrated application is not limiting on the invention.

The above discussion, examples, and embodiments illustrate my current understanding of the invention. However, since many variations of the invention can be made without departing from the spirit and scope of the invention, the invention resides wholly in the claims hereafter appended.

I claim:

1. A vacuum assembly for a rotating roll for handling sheet or web material, the rotating roll including a plurality of holes in an outer surface and passages that open onto a face of the roll that are in communication with the plurality of holes, wherein the holes are adapted to communicate a vacuum for holding and releasing the sheet or web material, comprising:

a vacuum manifold located in line with and outwardly of the roll face, wherein the vacuum manifold defines an internal cavity that is supplied with vacuum from a vacuum source; and a valve assembly positioned between the roll face and the vacuum manifold, wherein the valve assembly includes a passage arrangement configured to communicate vacuum throughout a portion of the rotation of the roll from the internal cavity of the vacuum manifold to the passages that open onto the roll face, wherein the valve assembly includes an intake region that communicates vacuum from the internal cavity of the vacuum manifold to the passages that open onto the roll face, and further includes an adjustment arrangement for adjusting the location of the intake region and the position of a pair of ends defined by the intake region that define the range of movement of the roll through which the passages that open onto the roll face are exposed to vacuum during rotation of the roll, wherein the valve assembly includes:

an outer slug plate;

an inner slug plate;

a spool mounted to the inner slug plate, the spool having an opening; and a cover coupled to the spool, wherein the cover and the spool cooperate to define the internal cavity, wherein the internal cavity is in communication with the spool opening;

wherein the outer slug plate and the inner slug plate are rotatably adjustable relative to the spool and to one another; and wherein the outer slug plate and the inner slug plate are configured to regulate the supply of vacuum from the internal cavity to the holes of the rotating roll.

2. The vacuum assembly as recited in claim 1, wherein the outer slug plate is in the form of a ring that includes an extension that extends radially inward from an inner surface defined by the ring.

3. The vacuum assembly as recited in claim 2, wherein the inner slug plate includes an opening in axial alignment with the extension of the outer slug plate, wherein a face defined by the extension of the outer slug plate relative to an end defined by the opening of the inner slug plate defines a vacuum intake region therebetween to communicate the vacuum pressure therethrough.

4. The vacuum assembly as recited in claim 3, further including a wear plate disposed between the outer slug plate and the rotating roll, the wear plate including a plurality of openings to communicate the flow of fluid from the plurality of holes in the rotating roll to the internal cavity defined between the spool and the cover.

5. The vacuum assembly as recited in claim 1, wherein the cover includes an inlet portion and a manifold portion coupled by a fastener, the manifold portion including a first port and a second port in communication with the internal cavity defined by the cover and the spool.

6. The vacuum assembly as recited in claim 1, further including means for controlling the positions of the outer slug plate and the inner slug plate while the rotating roll is moving, to adjust a dimension of the intake region.

7. The vacuum assembly as recited in claim 1, wherein the inner slug plate further includes a generally U-shaped opening to communicate certain of the holes of the rotating roll with atmosphere.

8. An interfolding machine for handling sheet or web material, comprising:

a rotating roll for holding and releasing the sheet or web material, the rotating roll including a plurality of holes along an outer surface for communicating a vacuum to the outer surface of the roll; and a vacuum assembly for interconnected with the rotating roll, comprising:

a vacuum manifold located in line with and outwardly of the roll face, wherein the vacuum manifold defines an internal cavity that is supplied with vacuum from a vacuum source; and a valve assembly positioned between the roll face and the vacuum manifold, wherein the valve assembly includes a passage arrangement configured to communicate vacuum throughout a portion of the rotation of the roll from the internal cavity of the vacuum manifold to the passages that open onto the roll face, wherein the valve assembly includes an intake region that communicates vacuum from the internal cavity of the vacuum manifold to the passages that open onto the roll face, and further includes an adjustment arrangement for adjusting the location of the intake region and the position of a pair of ends defined by the intake region that define the range of movement of the roll through which the passages that open onto the roll face are exposed to vacuum during rotation of the roll, wherein the valve assembly comprises:

an outer slug plate;

an inner slug plate;

means for rotatably coupling the outer slug plate and the inner slug plate;

a spool mounted to the inner slug plate, the spool having an opening; and a cover coupled to the spool, the cover defining a cavity with the spool, wherein the internal cavity is in communication with the spool opening, wherein the outer slug plate and the inner slug plate are rotatably adjustable relative to the spool and to one another; and wherein the outer slug plate and the inner slug plate are configured to regulate airflow from the internal cavity to the passages that open onto the roll face.

9. The interfolding machine as recited in claim 8, wherein the outer slug plate includes a ring structure having a gap, the ring structure having an extension extending radially inward from an inner surface of the ring structure.

10. The vacuum assembly as recited in claim 9, wherein the inner slug plate includes an opening in axial alignment with the extension of the outer slug plate, wherein a face defined by the extension of the outer slug plate relative to an end defined by the opening of the inner slug plate defines the intake region therebetween to communicate the vacuum therethrough.

11. The vacuum assembly as recited in claim 8, further including a wear plate disposed between the outer slug plate and the rotating roll, the wear plate including a plurality of openings to communicate air flow from the plurality of holes in the surface of the rotating roll to the internal cavity defined between the spool and the cover.

12. The vacuum assembly as recited in claim 8, wherein the cover includes a cover portion and a manifold portion coupled by a fastener, the manifold portion including at least one port in communication with the cavity defined by the cover and the spool.

13. The vacuum assembly as recited in claim 8, further including an actuator arrangement configured to control the positions of the outer slug plate and the inner slug plate while the rotating roll is moving, to adjust the position of the pair of ends defined by the intake region.

14. The vacuum assembly as recited in claim 8, wherein the inner slug plate further includes a generally U-shaped opening to communicate certain of the holes at the circumference of the rotating roll with atmosphere.

15. A method of regulating the supply of suction from a suction source to holes at a surface of a rotating roll and through roll ports in a side face of the rotating roll, the method comprising the acts of:

supplying vacuum from a vacuum source to a vacuum manifold located in line with and outwardly of the roll face, wherein the vacuum manifold defines an internal cavity that is supplied with vacuum; and communicating vacuum throughout a portion of the rotation of the roll from the internal cavity of the vacuum manifold to the roll ports via a valve assembly positioned between the roll face and the vacuum manifold, wherein the valve assembly includes a passage arrangement through which vacuum is supplied from the internal cavity to the roll ports, wherein the act of communicating vacuum throughout a portion of the rotation of the roll from the internal cavity of the vacuum manifold to the roll ports is carried out by positioning a first and second rotatable slug members between the vacuum pump and the roll port that supply the vacuum through an intake region of the valve assembly that communicates vacuum from the internal cavity of the vacuum manifold to the roll ports; rotatably adjusting the first slug member relative to an opening of the second slug member to control air flow between the suction source and the roll ports; routing the air flow into a cavity defined by a spool and a cover; and communicating the air flow from the cavity and through the cover to the vacuum pump.

16. The method as recited in claim 15, wherein the rotatably adjusting step includes positioning a face of an extension at an inner radial surface of the first slug member in relation to an edge defined by the opening in the second slug member, wherein a face of the extension relative to an edge defined by the opening variably defines the intake region.

17. The method as recited in claim 15, wherein the rotatably adjusting step is performed while the rotating roll is moving.

18. A vacuum assembly for a rotating roll for handling sheet or web material, the rotating roll including a plurality of holes in an outer surface and passages that open onto a face of the roll that are in communication with the plurality of holes, wherein the holes are adapted to communicate a vacuum for holding and releasing the sheet or web material, comprising:

a vacuum source;

a vacuum conduit extending from the vacuum source, wherein the vacuum conduit defines a proximal end and a distal end, wherein the proximal end is interconnected with the vacuum source;

a vacuum manifold located outwardly of the roll face, wherein the vacuum manifold defines an internal vacuum reservoir that is located in line with and outwardly of the roll face, wherein the distal end of the vacuum conduit is interconnected with the vacuum manifold so as to communicate vacuum from the vacuum source through the distal end of the vacuum conduit to the internal vacuum reservoir defined by the vacuum manifold; and a valve member positioned outwardly of the roll face and between the roll face and the vacuum manifold, wherein the internal vacuum reservoir defined by the vacuum manifold is located between the distal end of the vacuum conduit and the valve member, wherein the valve member includes a passage arrangement configured to communicate vacuum throughout a portion of the rotation of the roll, wherein vacuum is communicated from the internal vacuum reservoir of the vacuum manifold through the passage arrangement of the valve member to the passages that open onto the roll face;

wherein the valve member includes an intake region that communicates vacuum from the internal vacuum reservoir of the vacuum manifold to the passages that open onto the roll face, and further includes an adjustment arrangement for adjusting the location of the intake region and a dimension of the intake region that defines the range of movement of the roll through which the passages that open onto the roll face are exposed to vacuum during rotation of the roll;

wherein the vacuum manifold comprises a spool member located outwardly of the valve member and a cover arrangement secured to the spool member, wherein the spool member and the cover arrangement cooperate to form the internal vacuum reservoir.

19. The vacuum assembly of claim 18, wherein the spool member and the cover arrangement are configured to provide the internal vacuum reservoir with a generally annular configuration outwardly of the valve member.

20. The vacuum assembly of claim 18, wherein the valve member is rotatable also as to control the supply of vacuum from the internal vacuum reservoir to the roll face.

* * * * *